US005639132A

United States Patent [19]

Wartian

[11] Patent Number: 5,639,132

[45] Date of Patent: Jun. 17, 1997

[54] DOOR LATCH OPERATING MECHANISM

[76] Inventor: George Wartian, 34938 Island View Dr., E., Mt. Clemens, Mich. 48045

[21] Appl. No.: 503,505

[22] Filed: Jul. 18, 1995

[51] Int. Cl.[6] ..... E05B 1/00

[52] U.S. Cl. ..... 292/347; 292/348

[58] Field of Search ..... 292/347, 348, 292/336.3

[56] References Cited

U.S. PATENT DOCUMENTS

| | | | |
|---|---|---|---|
| 1,611,015 | 12/1926 | Freysinger | 292/347 X |
| 1,611,753 | 12/1926 | Keeler et al. | 292/347 |
| 1,878,394 | 9/1932 | Haan, Jr. | 292/347 |
| 2,058,685 | 10/1936 | Haan, Jr. | 292/347 |
| 2,306,867 | 12/1942 | Dean | 292/347 |
| 3,200,630 | 8/1965 | Wilson | 292/347 X |
| 3,283,400 | 11/1966 | Wilson | 292/347 X |

FOREIGN PATENT DOCUMENTS

| | | | |
|---|---|---|---|
| 283780 | 1/1928 | United Kingdom | 292/347 |
| 340461 | 1/1931 | United Kingdom | 292/347 |
| 1385014 | 2/1975 | United Kingdom | 292/347 |

*Primary Examiner*—Rodney M. Lindsey

*Attorney, Agent, or Firm*—Barnes, Kisselle, Raisch, Choate, Whittemore & Hulbert, PC

[57] ABSTRACT

Door latch-operating mechanism for retracting a door latch. A rotary shaft is mounted in a housing and is adapted to retract a latch when rotated. The shaft is turned by a handle on the outer end of the shaft. A tube is sleeved on the shaft between the handle and housing. The housing and handle are solid brass forgings. The tube is also solid brass. Any wear of the handle will not be noticed since it is solid brass rather than being made of some less attractive metal plated with brass. The shaft is completely covered and concealed by the brass housing, handle and tube.

4 Claims, 1 Drawing Sheet

DOOR LATCH OPERATING MECHANISM

FIELD OF THE INVENTION

This invention relates generally to door latches and refers more particularly to a door latch operating mechanism.

BACKGROUND AND SUMMARY

In many door latch assemblies, the latch is retracted by a rotary shaft. The shaft is turned by a handle. The handle and shaft may be formed as a one-piece zinc casting. For the sake of appearance, the handle may be plated with brass. The problem with brass plate, however, is that in a short time it wears away and exposes the base metal.

In accordance with the present invention, the handle is made entirely of brass. Because a metal mold will not withstand the high temperatures necessary to cast brass, the handle is preferably made as a forging. The shaft, usually of a less expensive metal such as zinc, may be cast, and preferably has a flange which is staked to the handle. A brass tube is preferably sleeved on the shaft. The entire unit, including a brass housing in which the shaft is mounted, is attractive and may be used indefinitely without showing any evidence of wear.

One object of this invention is to provide a door latch operating mechanism having the foregoing features.

Another object is to provide a door latch operating mechanism which is composed of a relatively few simple parts, is rugged and durable in use, and is capable of being readily manufactured and easily assembled.

Other objects, features and advantages of the invention will become more apparent as this description proceeds, especially when considered with the accompanying drawings.

DETAILED DESCRIPTION

Figure 2:
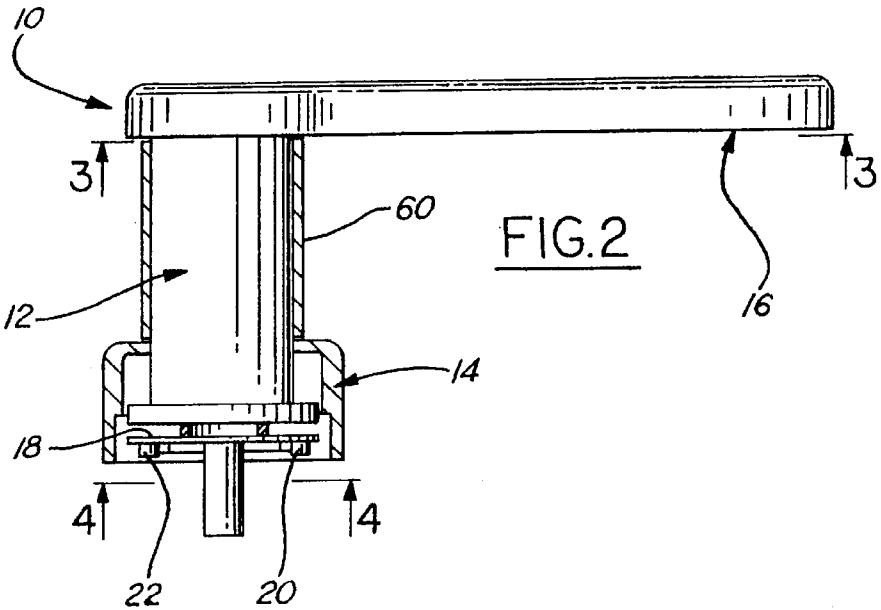
FIG. 2 is a view partly in section taken on the line 2—2 in FIG. 1.
Figure 4:
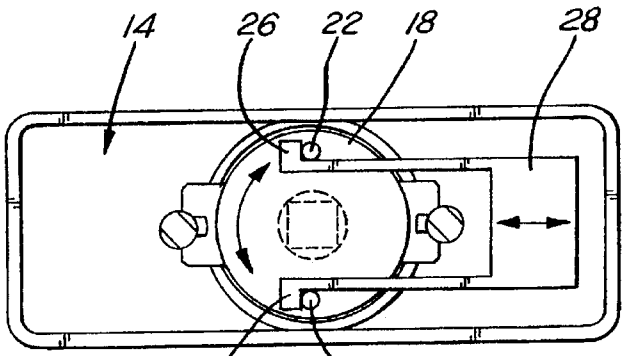
FIG. 4 is a view taken on the line 4—4 in FIG. 2.
Figure 1:
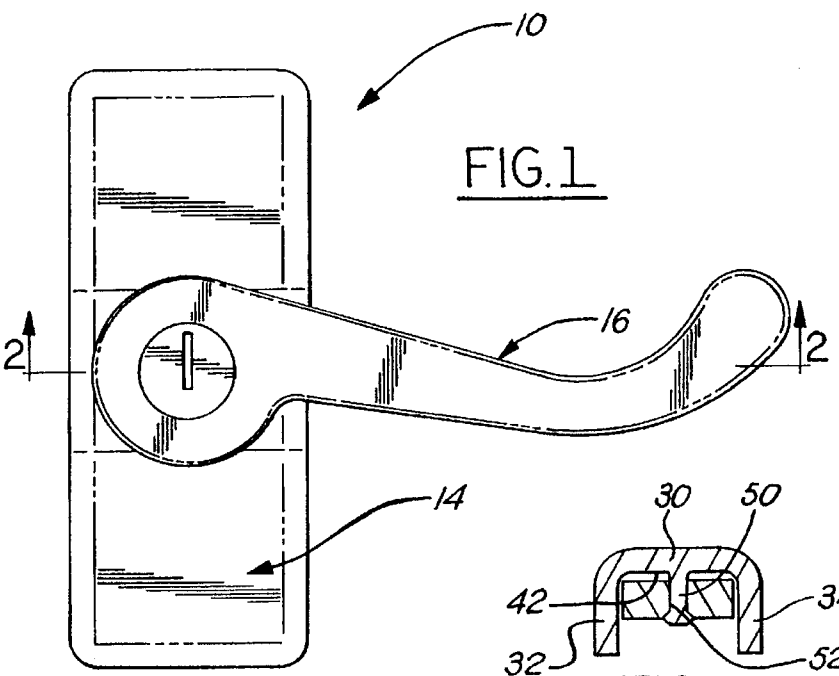
FIG. 1 is a plan view of a door latch assembly constructed in accordance with the invention.
Figure 5:
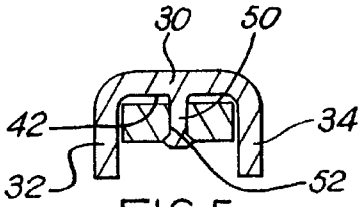
FIG. 5 is a sectional view taken on the line 5—5 in FIG. 3.
Figure 3:
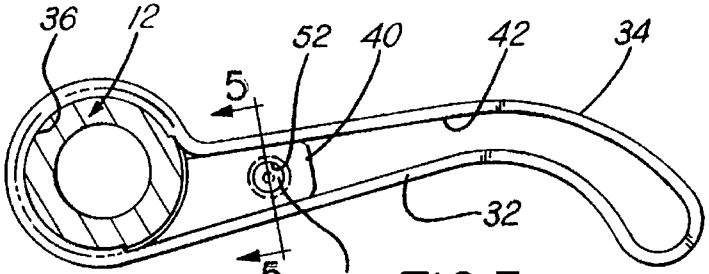
FIG. 3 is a view partly in section taken on the line 3—3 in FIG. 2.

Referring now more particularly to the drawings, the door latch assembly 10 comprises a rotary, cylindrical shaft 12 journalled for rotation in a housing 14, and a handle 16 for turning the shaft. A disc 18 affixed to the shaft has diametrically opposed pins 20 and 22 engageable with the respective abutments 24 and 26 on the latch 28 to retract the latch when the shaft is rotated.

The handle 16 is an elongated member generally U-shaped in cross-section having a top wall 30 and laterally spaced side walls 32 and 34. The side walls merge at the ends of the handle, providing a circular recess 36 at the inner end. The recess 36 at the inner end of the handle 16 fits over the top of the shaft 12.

The outer end of the shaft 12 has an integral, laterally outwardly extending flange 40 which extends into the trough 42 defined by the top and side walls of the handle 16 adjacent to recess 36. The side walls 32 and 34 of the handle extend below the flange 40 so that the flange is completely concealed from view when the unit is viewed from the top or the side. The top wall 30 has an integral pin 50 which extends perpendicular thereto into the trough. The pin 50 extends through a hole 52 in the flange 40 and is staked to provide a permanent and rigid connection.

A tube 60 is sleeved on the shaft 12 between the housing 14 and the handle 16.

Both the handle 16 and the housing 14 are solid brass, preferably forgings. The tube 60 is also solid brass.

The shaft 12 may be made of any suitable, usually less expensive material such, for example, as zinc, and may be formed as a casting.

The entire assembly is attractive in appearance, since all of the exposed parts, namely, the housing 14, handle 16 and tube 60 are formed of brass. The shaft 12 is completely covered and concealed by the housing, tube and handle. The assembly can be used for a long period of time without showing any evidence of wear. Any actual wear of the handle is unnoticeable because the handle is made of solid brass.

I claim:

1. Door latch operating mechanism for retracting a door latch, comprising a solid brass housing, a cylindrical shaft, means mounting said shaft in said housing for rotation, said shaft adapted to be operably connected to a door latch to retract the same upon rotation thereof, said shaft projecting outwardly from said housing and having an outer end spaced from said housing, an elongated solid brass handle for rotating said shaft, means attaching said handle to the outer end of said shaft, and a solid brass tube sleeved on said shaft between said housing and said handle, said means attaching said handle to the outer end of said shaft comprising a flange integrally formed on the outer end of said shaft and projecting beyond an outer circumference of said shaft, said flange having means providing a hole, and a pin integrally formed on said handle extending into said hole, said pin being staked to lock said pin in said hole.

2. Door latch mechanism as defined in claim 1, wherein said handle is U-shaped in cross-section having a top wall and laterally spaced side walls extending downward from said top wall and defining a trough adjacent the inner end thereof, said flange extending into said trough, said side walls extending beneath said flange so the said flange is completely concealed from view when said handle is viewed from the top and side.

3. Door latch mechanism as defined in claim 2, wherein said shaft is completely covered by said housing, tube and handle.

4. Door latch mechanism as defined in claim 3, wherein said handle and housing are forgings.

* * * * *